US005850830A

United States Patent [19]

Smith

[11] Patent Number: 5,850,830

[45] Date of Patent: Dec. 22, 1998

[54] HEAT REFLECTOR FOR USE WITH FIREPLACE GRATE FOR HIGH TEMPERATURE COMBUSTION

[76] Inventor: Richard D. Smith, 2415 S. Court, Palo Alto, Calif. 94301

[21] Appl. No.: 779,702

[22] Filed: Jan. 7, 1997

[51] Int. Cl.[6] ..... F24B 1/195

[52] U.S. Cl. ..... 126/552; 126/540; 126/152 R; 126/163 R; 126/500; 126/553

[58] Field of Search ..... 126/552, 540, 126/152 R, 163 R, 164, 165, 500, 553, 541

[56] References Cited

U.S. PATENT DOCUMENTS

| | | | |
|---|---|---|---|
| 3,265,057 | 8/1966 | Horne | 126/92 B |
| 4,574,774 | 3/1986 | Wells | 126/164 |
| 4,964,397 | 10/1990 | Purcell et al. | 126/552 |
| 5,282,459 | 2/1994 | Soule | 126/552 |
| 5,469,839 | 11/1995 | Kasulis et al. | 126/552 |
| 5,575,275 | 11/1996 | Gazaille | 126/540 |

*Primary Examiner*—Larry Jones

[57] ABSTRACT

A low thermal mass heat reflector for use with a fireplace grate which has a combustion zone directly thereabove when fuel is burned thereon in a fireplace. The heat reflector comprises a first portion for absorbing radiant energy from the combustion zone and reradiating thermal energy back into the combustion zone, and a second portion for absorbing radiant energy from the combustion zone and reradiating thermal energy over the fireplace grate and out of the fireplace.

8 Claims, 5 Drawing Sheets

HEAT REFLECTOR FOR USE WITH FIREPLACE GRATE FOR HIGH TEMPERATURE COMBUSTION

FIELD OF THE INVENTION

The present invention is directed to a heat reflector for use with a fireplace grate for burning solid fuel cleanly and efficiently in a fireplace.

BACKGROUND OF THE INVENTION

As all areas of the nation strive for cleaner air, the focus of correction is shifting from primary industrial and vehicular sources of pollution to secondary sources of pollution, such as wood burning fireplaces. In many residential areas, a complete ban on wood burning fireplaces is being proposed. In certain geographical areas where the topography is such that pollutants collect and are not readily blown away, such as Denver, Colo. and Beaver Creek, Colo., restrictions on wood burning fireplaces have now been in place for over ten years.

Pollution is caused because fireplaces do not burn all of the fuel vapor escaping from the burning wood and these fuel vapors are transported up the chimney into the atmosphere. For clean combustion, thorough mixing of the air and fuel vapor is required to achieve intimate contact between oxygen and fuel molecules. In addition, the mixture must be at a temperature high enough to cause the reaction to occur and sufficient time must be available to allow the reaction to go to completion. The reaction rate increases exponentially with increasing temperature so it is highly desirable to generate high temperatures to complete the reactions in the shortest time possible before the reactants have escaped from the hot combustion zone of the fire and have been cooled below their ignition temperature by dilution with excess air or heat transfer to the surroundings.

Existing fireplaces use natural draft to bring oxygen to the burning surfaces of the wood as well as to cause mixing of the fuel vapor and oxygen in the combustion zone. Natural draft forces result from the buoyancy of heated air or combustion gas, bringing new air to the combustion zone. Unfortunately, these buoyant forces are extremely weak (normally less than 0.01 inches of water gage (IWG)) and result in very low velocities and turbulence levels over the burning surface. These low velocities limit the rate at which combustion can occur on the burning surface of the wood and also limit the mixing of the volatile fuel vapor with the combustion air. Because of the limited combustion rate on the wood surface and limited combustion of the volatiles in the combustion zone, temperatures in the normal combustion zone in existing fireplaces are usually too low to allow complete combustion of the fuel vapors before they escape from the combustion zone and are cooled still further.

A further problem arises because of the coupling of the fire with the natural draft. Wood in a fireplace does not burn with uniform intensity over its entire surface but rather has zones where it burns with high intensity and zones where very little combustion occurs. The zones with high intensity create the most buoyant forces and hence, the most intense local draft. The hottest part of the fire tends to become even hotter. Unfortunately, the cooler part of the fire, which badly needs a stronger draft to burn hotter and cleaner, is unable to generate that draft so it tends to cool further and pollute more. Near the end of a fireplace fire, when the hottest zones of the fire have all burned out, little draft is left to burn the smoldering logs yet remaining and to prevent large quantities of unburned volatiles from escaping into the atmosphere.

Measurements taken in an open fireplace indicate that the combustion zone in which adequate combustion temperatures may be achieved is localized to within a few inches of the burning wood and often is found only in the interstices between logs where the radiated heat from the burning surface is retained in a cavity. Fireplaces burn with large amounts of excess air (2000% excess air was measured in one test) that dilute and cool the combustion gas below combustion temperature shortly after it leaves the surface of the wood. Temperatures measured twelve inches above the fire in a fireplace are approximately 200° F., well below the nominal 1000° F. needed to initiate the combustion reactions. Hence, for fireplaces, the only opportunity to achieve clean combustion by burning the volatile vapors exists while the vapors are in the combustion zone, immediately adjacent to the surface of the wood.

The reflecting surfaces in most fireplaces are either brick, stone or metal. These have high thermal mass and absorb heat for a considerable time after the fire is underway, thereby actually cooling the fire. Only after they have been thoroughly heated do they radiate any significant heat energy back into the fire. Practically speaking, they do virtually nothing to enhance the efficient burning of the fire and are detrimental to it during the early stages thereof.

In U.S. Pat. No. 4,515,147 (fully incorporated herein by reference) granted to me and Samuel J. Van Grouw, entitled "Clean Burning Grate for Fireplaces and Wood Stoves" we have taught a fireplace grate which provides a uniform supply of forced air to the entire lower surface of the burning logs and the maintenance of a combustion zone provided by a bed of hot coals adjacent to the lower surface of the burning logs. However, even this highly efficient combustion enhancing device could be improved by an increase in combustion efficiency which would result in pollution reduction and heating of the room in which the fireplace is located.

SUMMARY OF THE INVENTION

The present invention substantially overcomes the above problems by providing a uniquely designed low thermal mass radiant energy heat reflector for use with a fireplace grate. When placed behind the grate, the combination creates a high temperature combustion zone between a lower portion of the radiant heat reflector and the upper surface of the grate. An upper portion of the radiant heat reflector, located above the grate, is curved to reflect radiant energy over the grate and into the room. Greater efficiency of combustion may be achieved with my improved Clean Burning Grate through which a forced flow of preheated air is uniformly distributed across the entire lower surface of logs placed thereon and which maintains troughs of glowing coals in close proximity to the bottom surface of the logs.

Because of the high temperatures and turbulent mixing created by the Clean Burning Grate and the rapid reradiation of substantially all of the heat of combustion directed onto the uniquely designed heat reflector of the present invention, volatile fuel vapors are burned to substantial completion before they escape the combustion zone and before there is any chance that their reaction will be quenched by rapid cooling to below the combustion temperature. The Clean Burning Grate creates a high temperature combustion zone located in the region between the radiant heat reflector and the logs and, in particular, in troughs between the bottom surfaces of the burning logs and the upper surfaces of the bed of glowing coals and the side walls of the grate supports. The glowing coals are held in close proximity to the bottom of the log by the improved grate. Radiant heat transfer varies as the square of the distance between the two surfaces. The closer the surfaces, the more intense the heat transfer between these two surfaces and the fewer the losses from edge effects.

The primary objective of the present invention is to reduce the pollution from wood burning fireplaces. It also offers the benefits of easy starting, better aesthetics from the fire, near maintenance free operation of the fire, reduction in the consumption of wood by eliminating the need for a second layer of wood on the fire, burning all logs completely to the end of the fire and burning damp wood or difficult species of wood easily. Because of the high temperatures existing in the combustion zone, radiant heat into the room is greatly increased. The transfer of this radiant heat into the room is greatly assisted by the radiant heat reflector design, the upper portion of which reflects the heat otherwise wasted by heating the bricks, stones or metal surfaces at the rear of the fireplace.

These and other features and advantages of the present invention will become more apparent upon a perusal of the following description wherein similar characters of reference refer to similar parts in each of the several views.

DETAILED DESCRIPTION OF THE DRAWINGS

Figure 1:
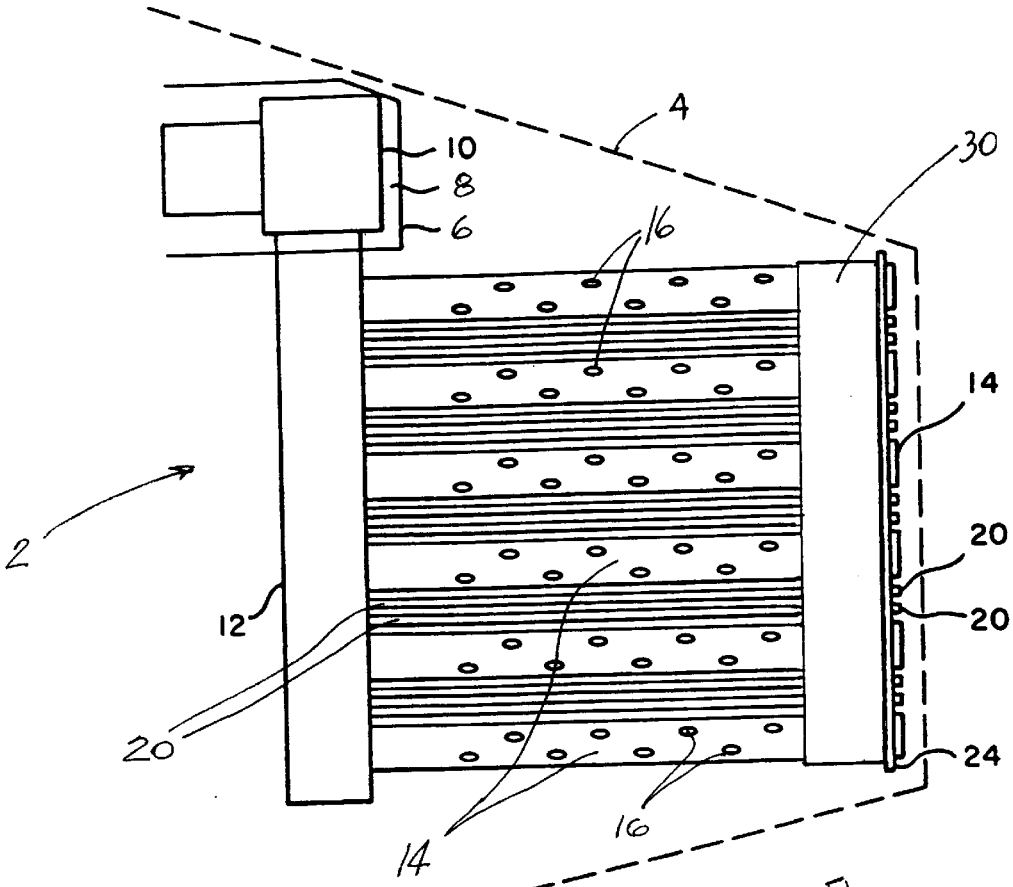
FIG. 1 is a top view of the Clean Burning Grate with Heat Reflector showing its mounting in a conventional fireplace.
Figure 2:
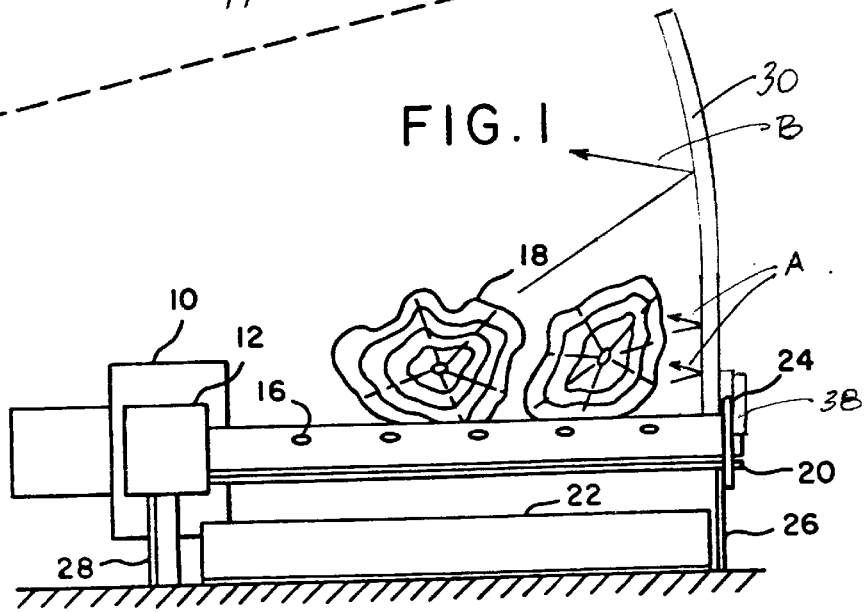
FIG. 2 is a side elevational view of the Clean Burning Grate with Heat Reflector illustrating two logs on the grate.
Figure 3:
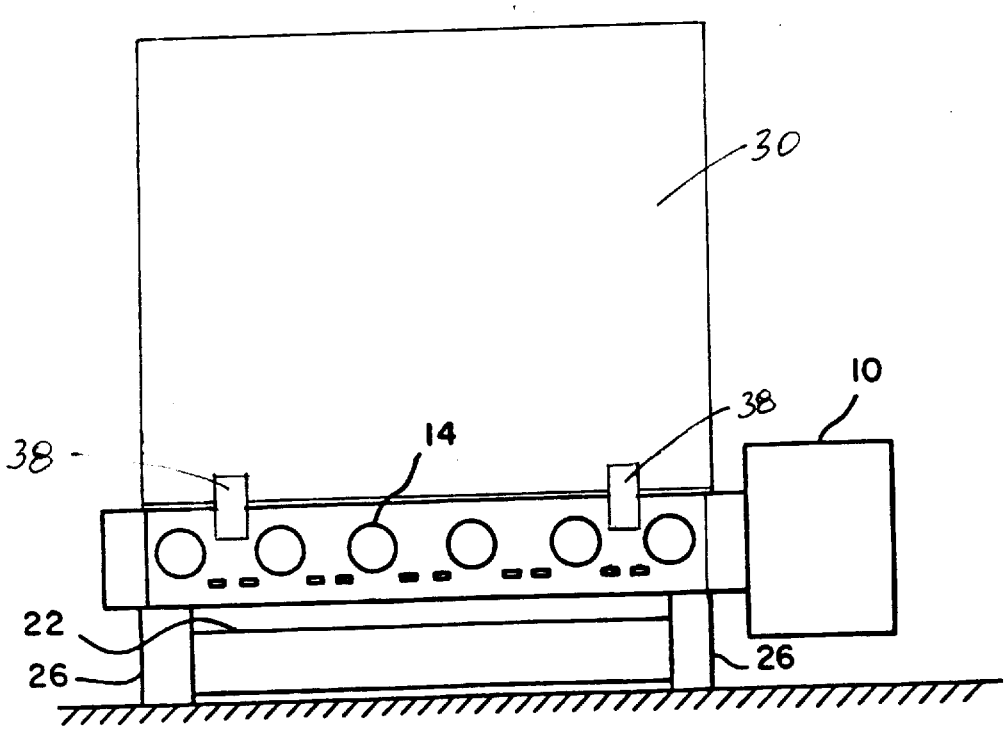
FIG. 3 is a rear elevational view of the Clean Burning Grate with Heat Reflector.
Figure 4:
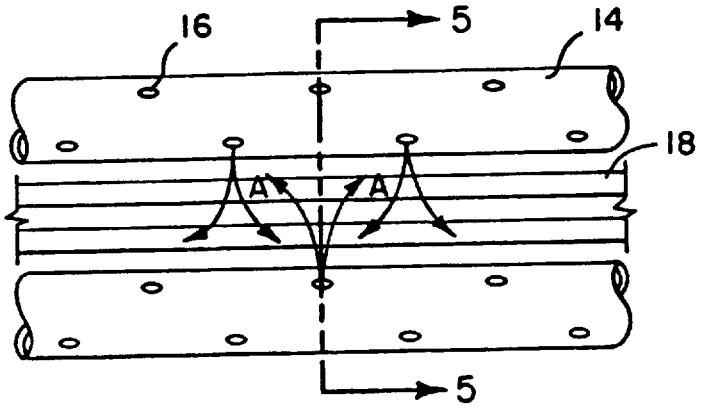
FIG. 4 is a partial top view showing the relationship of the orifices and the air flow pattern created thereby.

Turning now to the drawings, the dashed line 4 in FIG. 1 represents the outline of the interior of a fireplace in which the Clean Burning Grate 2 is mounted. The entire grate including blower 10 and its motor are mounted within the fireplace for minimum intrusion on the aesthetics of the fireplace. The fan is hidden behind the opened fireplace screen. The fan and fan motor are protected from radiation and convection from the fire by the heat shield 6 and cooled by the flow of air drawn over its inner surface during normal operation. The air inlet 8 to the blower 10 is located adjacent to the innermost wall of the heat shield 6.

For easy starting and quick ignition when new logs are added to the fire, the fan has a high speed setting. Under normal operation, the fan produces 0.1 IWG but for starting and quick ignition it produces 0.2 to 0.6 IWG. This large amount of air at high jet velocities produces high burning rates and provides a fully lighted fire within three minutes from a cold start. Thus, compared to conventional wood fires with a natural draft, the Clean Burning Grate provides much easier starting, always a problem when building a wood fire.

Figure 5:
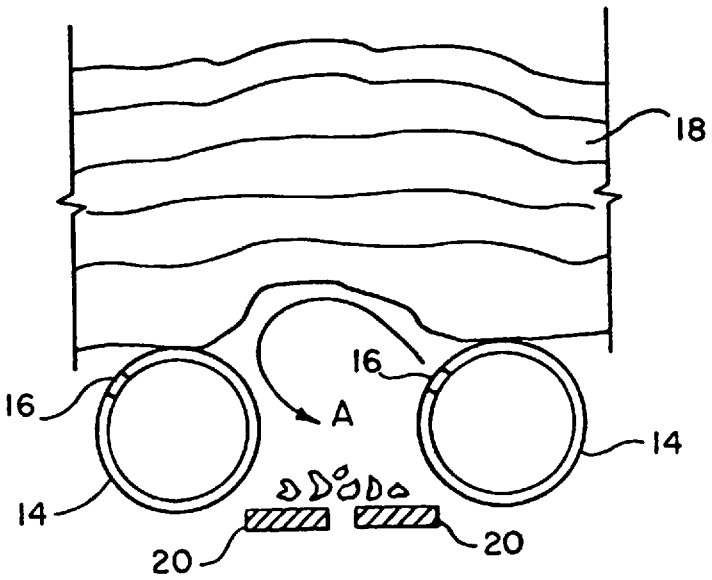
FIG. 5 is a sectional view taken substantially along line 5—5 of FIG. 4 showing the air flow pattern.

The details of the Clean Burning Grate 2, made in accordance with the teachings in my above-identified patent, are illustrated in FIGS. 1 to 5. The blower 10 which supplies air at low pressure in the range from about 0.1 to 1.0 inches of water gage (IWG) to manifold 12 and thence to a multiplicity of hollow grate bars 14. At nominal conditions the blower supplies air in the range from 6 to 10 SCFM of air to a small fireplace. The air passes through the hollow grate bars and is heated from 500° F. to 1000° F. by the hot walls of the grate bars. The heated air issues from a multiplicity of orifices 16 producing jets of heated air directed at the undersurface of the logs 18 resting on the grate bars. As illustrated in FIG. 1, the orifices 16 are spaced over the entire area of the grate. The orifices are preferably 5/32 inch in diameter, drilled at a preferred angle of 45 degrees to the vertical (as best seen in FIG. 5). The orifices should be larger than 3/32 inch and smaller than 3/8 inch in diameter and should be oriented from 0 to 60 degrees from the vertical. The hole pattern is staggered between grate bars to assure an optimum flow of preheated air over the undersurface of the entire log and to establish a turbulent air flow pattern as indicated by the arrows A in FIGS. 4 and 5. Air jets are generally directed upward but preferably with an adequate horizontal component to provide a sweeping flow of air over the majority of the lower surfaces of the wood.

Hot glowing coals are retained between the grate bars in intimate contact with the lower surface of the logs by means of coals retaining strips 20. The glowing coals reside in the trough 21 (see FIG. 5) defined by adjacent grate bars and coals retaining strips 20, where they provide the lower hot surface for the combustion zone as well as heat the grate bars, which in turn preheat the incoming air. Thus, to the maximum extent possible, the heat of the fire is focused into a high temperature combustion zone near the upper surface of the grate. Passageways between adjacent coals retaining strips as well as passageways between coals retaining strips 20 and grate bars 14 allow ash and spent coals to drop into the ash pan 22 when their size has been reduced to approximately 3/8 inch diameter. Thus, an intense combustion zone is located between the upper surface of the bed of coals and the lower surface of the logs. This zone exists uniformly over the entire area of the grate. Radiation is trapped between the hot combustion surface of the log and the glowing surface of the coals. Into this area air preheated to 500° F. to 1000° F. is injected to provide oxygen and turbulence to burn fuel volatiles. The jets produce cavities in the lower surfaces of the burning logs which may grow to several inches in diameter and act to further trap radiant heat. The cavities themselves become excellent local combustion devices because they act as black bodies, trapping radiation from the burning surface. Temperatures of over 1700° F. are routinely measured in the combustion zone; temperatures over 2000° F. have been measured in the cavities. The elevated temperature, high turbulence and abundant supply of preheated air provide excellent combustion conditions, and burn fuel volatiles quickly.

The air manifold 12 is a 2×2 inch hollow square tube made of mild steel. All hot parts comprising the grate bars 14, coals retaining strips 20, back structural support 24, back legs 26 and front legs 28 are made from 304 stainless steel to resist oxidation at elevated temperatures above 1000° F., ensuring long life for the Clean Burning Grate. The ash pan 22 is made from mild steel with surface protection which is adequate to prevent oxidation as its peak temperature is well below that of the grate.

The individual elements of the grate are subjected to uneven temperatures during start up, shut down and in normal operation. To prevent these uneven temperatures from causing thermal stresses within the grate, special design features are incorporated. The two outer grate bars 14 will always operate the coolest and they are welded to the back structural support 24. The remaining grate bars rest in holes in the back structural support which are large enough to enable the grate bars to move freely in and out as required. All of the coals retaining strips rest in rectangular openings in the back structural support and are also free to individually move back and forth. All grate bars and coals retaining strips are welded to the manifold.

Figure 9:
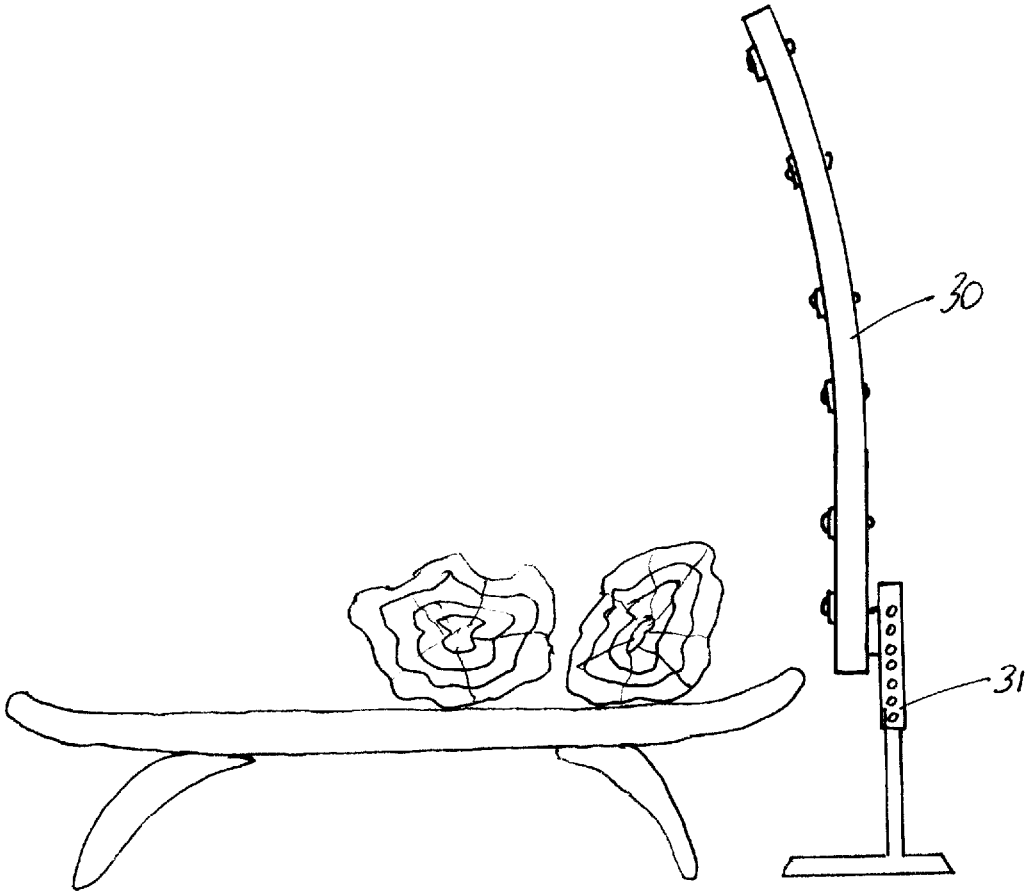
FIG. 9 is a side elevational view of a standard grate with an alternative embodiment of Heat Reflector which is free-standing

Heat transfer from radiation increases with the fourth power of the temperature of the body providing the radiation. Thus, a combustion zone operating at 1800° F. will radiate 2.7 times as much heat as a combustion zone operating at 1400° F. Hence, the Clean Burning Grate alone, by virtue of its high combustion zone temperatures, radiates much more than a wood fire in a conventional fireplace. To take advantage of this increased radiant heat that normally leaks from the combustion zone, and to pump it back into the fire, a heat reflector 30 is mounted at the rear of the grate to reflect this heat back into the fire and into the room. As shown, the heat reflector is mounted directly onto the grate. However, it should be understood that it may be self supported on its own feet 31 and placed directly behind any grate (as shown in FIG. 9). In this embodiment, the feet would be preferably adjustable to enable the reflective surfaces to be properly positioned relative to the combustion zone (as will become apparent). The shape of the heat reflector is uniquely designed to reflect the heat immediately above the rear of the fire directly back into the combustion zone (note arrows A in FIG. 2), making the fire burn hotter and more pollution free, and to reflect the majority of radiant heat rising above the combustion zone into the room (note arrow B in FIG. 2).

Figure 6:
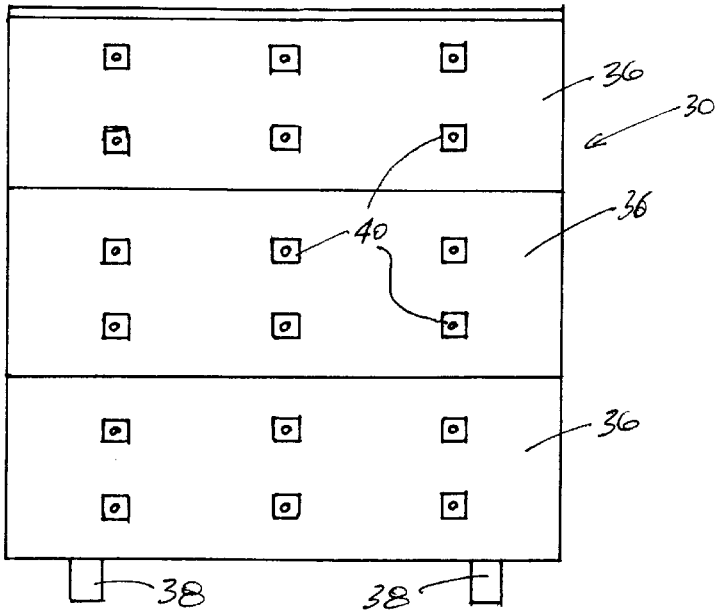
FIG. 6 is front view of the Heat Reflector.
Figure 7:
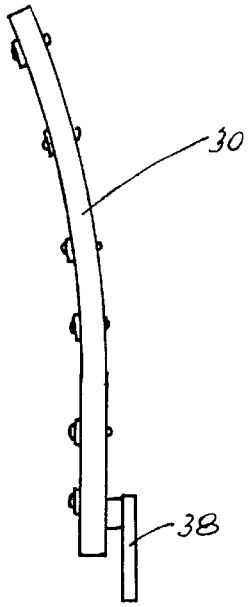
FIG. 7 is a side view of the Heat Reflector.

In its preferred embodiment, the width of the heat reflector 30 is substantially coextensive with that of the grate and extends about 12 inches above it. It has two distinct portions, a lower heat pumping section which extends vertically above the grate, and an upper heat reflecting section which has a radius of curvature of about 33 inches. The lower section comprises about one-third of the heat reflector and is substantially tangent to the upper section which comprises the remaining two-thirds of the heat reflector. The radius of curvature is selected to maximize the radiant energy reflected from the fire into the room. Details of the heat reflector can be seen in FIGS. 6 to 8. It comprises a laminar structure including a structural support layer 32 which gives it its shape and strength, an insulating layer 34 and a low thermal mass reflecting layer 36. The structural support layer 32, defining the shape described above, is made of 13 gage (0.0679 inch) mild steel and has mounting lugs 38 extending from the bottom thereof for allowing it to straddle the back structural support 24 of the grate. The insulating layer comprises about 0.25 inch of a packed ceramic fiber blanket, such as Kaowool™ a registered trademark of Thermal Ceramics, Inc. of Dunn, N.C. The low thermal mass reflecting layer 36 is comprised of three thin stainless steel sheets, each about 0.0024 inches thick, made thin so as to heat immediately upon receiving radiant energy from the fire and reradiate almost all of the heat back into the fire and into the room with little loss into the structural layer and into the fireplace walls.

Figure 8:
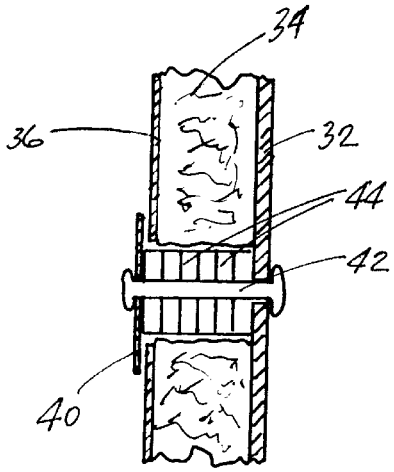
FIG. 8 is an enlarged sectional view of the Heat Reflector.

Because heating in a fireplace is inevitably non-uniform, heating of the low thermal mass reflecting layer is uneven and the thin stainless steel sheets 36 of which it is made will expand unevenly. In order to compensate for this uneven expansion, each of the three thin stainless steel sheets is held in place by a number of capture plates 40, made of stainless steel, which overlie the face of each sheet, as shown in FIG. 8. Each capture plate is secured to, and spaced from, the structural support layer by means of a rivet and is spaced from the support layer by means of a stake 42 supporting a gang of washers 44. The washers pass through suitable openings 46 in the insulating layer 34. Apertures 48 in the steel sheets are larger than the washers 44, thereby allowing the sheets to float under the capture plates during expansion and contraction, without distortion of their reflective surfaces. Thus, the steel sheets are maintained flat and the direction of reradiation therefrom is not compromised.

When burning a wood fire in a fireplace, the desired result is to obtain a pleasant appearance and provide a cheery radiant warmth to the room in which the fireplace is located. Because of the hotter fire which results from the combined heat reflector and Clean Burning Grate, these effects are achieved with only one log or two logs on the fire rather than the three or more necessary to maintain a conventional fire. Wood is saved because only one or two logs are required on the fire rather than three, but this savings is partially offset by the faster burning rate of the logs due to better combustion conditions. In one test, the Clean Burning Grate burned for 90 minutes with two logs and a conventional grate burned for 125 minutes with three logs, resulting in wood savings of 8% for the same burning time of the fireplace.

Although a conventional fire of three or more logs burns longer than a similar one utilizing the present invention, the quality of the conventional fire degrades markedly during the last portion of its life into largely smoking logs with very little flame. This is the portion of a conventional fire where major amounts of volatile emissions escape to the atmosphere. By contrast, the fire utilizing the present invention has a shorter overall burning time, for a given amount of fuel, but is pleasing to view throughout its entire burning cycle. It also eliminates the higher pollution at the end of the burn cycle.

Another feature of the device of the present invention is its ability to burn large logs well. Once a bed of coals has been established in the grate, the grate will easily burn the largest log that can be conveniently placed in the fireplace. Burning large logs is an advantage because it reduces the work of the wood cutter.

Yet another advantage of the device of the present invention is that the fire therewith is relatively maintenance free. In a normal fire, manipulation of the wood is frequently necessary to maintain a cheery fire because of the low temperatures of the combustion zone and hence marginal conditions for good combustion. The Clean Burning Grate enhanced with my unique Heat Reflector provides excellent burning conditions that are easily maintained.

Although the present invention of a low thermal mass radiant energy heat reflector for use in combination with a fireplace grate has been described as being used with the Clean Burning Grate, described in the above-identified patent, it should be understood that the unique heat reflector described herein may be used in combination with standard fireplace grates with some beneficial results. Clearly, combustion efficiencies will be higher with grates designed to increase the combustion temperature, and the Clean Burning Grate, in particular.

If all of the combustion in the wood fire were to occur in the combustion zone between the bottom surfaces of the logs and the coals on the grate, combustion of the volatiles would be nearly complete. Unfortunately, wood fires are made from random shaped logs and the hot gases sweep around the outside of the logs on the way to the chimney. Consequently, the sides and upper surfaces of the logs are heated enough to emit volatiles which are often not burned because they are cooler than at the base of the fire. The heat reflector which radiates heat back into this zone of the fire, improves the combustion of the volatiles that are generated higher in the fire. However, some of the volatiles inevitably escape without burning so that the combined Heat Reflector and Clean Burning Grate will offer a significant reduction in pollution, but will not be 100% pollution free.

What is claimed is:

1. The combination of a heat reflector and a fireplace grate having improved combustion efficiency, said grate having a combustion zone directly thereabove when fuel is burned thereon in a fireplace, wherein said grate comprises a plurality of substantially parallel, hollow first support members defining a first generally planar surface for supporting the lower surface of solid fuel, said combustion zone being located in the region above said first planar surface, a plurality of substantially parallel second support members defining a second generally planar support surface located below said first surface, said second support members being located between alternate ones of said first support members and defining, in combination with said first support members, a plurality of troughs for supporting glowing coals, a multiplicity of orifices extending through each of said first support members, each orifice being directed toward said first planar surface for creating a zone of turbulence in one of said troughs beneath the lower surface of the solid fuel, and a blower in communication with said first support members for moving air to and through said orifices, and wherein said heat reflector comprises a first portion for absorbing radiant energy from the combustion zone and reradiating thermal energy back into the combustion zone, and a second portion for absorbing radiant energy from the combustion zone and reradiating thermal energy over the fireplace grate and out of the fireplace.

2. The combination of heat reflector and fireplace grate as defined in claim 1 including mounting members thereon for attaching said heat reflector to said fireplace grate.

3. The combination of heat reflector and fireplace grate as defined in claim 1 wherein said first portion is located beneath said second portion and comprises about one-third of the height of said heat reflector, and said second portion comprises about two-thirds of the height of said heat reflector.

4. The combination of heat reflector and fireplace grate as defined in claim 1 wherein said second portion is curved and said first portion is planar and is tangent to said curved second portion.

5. The combination of heat reflector and fireplace grate as defined in claim 1 wherein each of said radiating surfaces of said first and second portions comprises a low thermal mass material.

6. The combination of heat reflector and fireplace grate as defined in claim 1 wherein said low thermal mass material comprises a thin sheet of stainless steel.

7. The combination of heat reflector and fireplace grate as defined in claim 6 wherein said first and second portions comprise a laminar structure including a structural support layer, a thermal insulating layer located adjacent to said support layer, and a low thermal mass reflecting layer for radiating thermal energy located adjacent to said insulating layer.

8. The combination of heat reflector and fireplace grate as defined in claim 1 wherein said reflecting layer is planar and is mounted in said laminar structure so as to expand and contract without distortion of its planarity.

* * * * *